US005513432A

United States Patent [19]

Sasaki et al.

[11] Patent Number: 5,513,432

[45] Date of Patent: May 7, 1996

[54] HEAT EXCHANGER AND METHOD FOR MANUFACTURING THE SAME

[75] Inventors: Kenichi Sasaki; Tomohiro Chiba, both of Isesaki, Japan

[73] Assignee: Sanden Corporation, Japan

[21] Appl. No.: 385,165

[22] Filed: Feb. 7, 1995

Related U.S. Application Data

[62] Division of Ser. No. 130,718, Oct. 4, 1993, Pat. No. 5,411, 079.

[30] Foreign Application Priority Data

Oct. 6, 1992 [JP] Japan ..... 4-267047

[51] Int. Cl.[6] ..... E21B 37/00

[52] U.S. Cl. ..... 29/890.038; 165/171

[58] Field of Search ..... 29/890.038, 890.046, 29/890.047, 890.05; 165/151, 171, 173, 176

[56] References Cited

U.S. PATENT DOCUMENTS

| | | | |
|---|---|---|---|
| 1,903,125 | 3/1933 | Modine | 165/171 X |
| 2,734,259 | 2/1956 | Beck | 165/168 |
| 3,495,657 | 2/1970 | Keith | 29/890.046 X |
| 3,648,768 | 3/1972 | Schöll | 165/176 |
| 3,962,766 | 6/1976 | Pompidor et al. | 165/171 X |
| 4,071,934 | 2/1978 | Zolman et al. | 29/890.046 |
| 4,160,476 | 7/1979 | Ashton et al. | 165/171 |
| 4,235,281 | 11/1980 | Fitch et al. | 165/174 X |
| 4,313,430 | 2/1982 | Britner et al. | 29/890.046 X |
| 4,428,420 | 1/1984 | Blakely | 29/890.046 X |
| 5,067,562 | 11/1991 | Ishii . | |
| 5,099,576 | 3/1992 | Shinmura . | |
| 5,119,552 | 6/1992 | Sutou et al. . | |

FOREIGN PATENT DOCUMENTS

| | | | |
|---|---|---|---|
| 527341 | 6/1931 | Germany . | |
| 251602 | 11/1947 | Switzerland . | |
| 685517 | 1/1953 | United Kingdom | 165/171 |

*Primary Examiner*—Stephen M. Hepperle
*Attorney, Agent, or Firm*—Baker & Botts

[57] ABSTRACT

A heat exchanger includes a first tank and a second tank, an inlet and an outlet each connected to either the first tank or the second tank, and a plurality of panel units provided between and connected to the first and second tanks. Each of the panel units has a plurality of tube portions formed as fluid paths and a plurality of plate portions connecting adjacent tube portions and having a thickness less than a thickness of the tube portions. The heat exchanger is light-weight, can be easily assembled and can have a high efficiency in heat exchange.

4 Claims, 5 Drawing Sheets

HEAT EXCHANGER AND METHOD FOR MANUFACTURING THE SAME

This application is a division of application Ser. No. 08/130,718, filed Oct. 4, 1993 entitled "*Heat Exchanger and Method for Manufacturing the Same*" now U.S. Pat. No. 5,411,079.

BACKGROUND OF THE INVENTION

1. Field of the Invention

The present invention relates to a small and lightweight heat exchanger suitable for use in an air conditioner for vehicles and a method for manufacturing the same.

2. Description of the Related Art

JP-A-SHO 61-153388 and JP-A-SHO 61-153389 disclose a heat exchanger in which heat exchanging tubes having a diameter of not more than 3 mm are disposed at a pitch of not more than 3 mm and the tubes are connected by meshes provided instead of fins for increasing the heat transfer area and improving the efficiency of heat exchange. In such a heat exchanger, however, as the number of heat transfer tubes increases, handling and assembly become more difficult, the number of meshes increases and the cost of the heat exchanger increases.

U.S. Pat. No. 4,235,281 discloses a heat exchanger in which a pair of thin film sheets each having recessed portions are bonded to each other to form a panel unit having tube portions and plate portions connecting adjacent tube portions. In this heat exchanger, the thin film sheets are plastic film sheets with a thickness of 0.01–0.25 mm. Generally, a metal such as aluminium or an aluminum alloy is used as the material for a heat exchanger for vehicles. If the structure of U.S. Pat. No. 4,235,281 were to be used for a heat exchanger for vehicles, the thickness of each tube must be set to at least about 0.4 mm to satisfy the requirements for pressure resistance and corrosion resistance. Consequently, because a pair of sheets are bonded to form a panel unit in the structure of U.S. Pat. No. 4,235,281, the thickness of plate portions formed by such a method becomes at least 0.8 mm. A lightweight heat exchanger cannot be achieved by such a structure.

Further, in a conventional method for merely forming a panel unit 101 having tube portions 102 with a thickness $t_1$ and plate portions 103 with a thickness $t_2$, as shown in FIG. 8, by extrusion, it is difficult to set the thickness $t_2$ of plate portions 103 to a small value and the width "w" of plate portions 103 to a large value due at least in part to flowability constraints of the material being extruded. As a result, a lightweight heat exchanger cannot be achieved by such a method.

SUMMARY OF THE INVENTION

Accordingly, an object of the present invention is to provide a heat exchanger which may be lightweight and small, which may be easily assembled, and which is highly efficient.

To achieve this object, one preferred embodiment of a heat exchanger comprises a first tank and a second tank, an inlet connected to either the first or second tank, an outlet connected to either the first or second tank, and a plurality of panel units provided between and connected to the first and second tanks. Each of the panel units comprises a plurality of tube portions formed as fluid paths communicating between the first and second tanks and a plurality of plate portions connecting adjacent tube portions. The plate portions have a thickness less than a thickness of the tube portions.

Such a heat exchanger according to the present invention may be constructed by one of the following preferred methods.

For example, the method of manufacturing the heat exchanger according to one preferred embodiment comprises the steps of forming a plurality of units having the plurality of tube portions and a plurality of plate portions connecting each of adjacent tube portions, and pressing the plate portions so that a thickness of the plate portions is less than a thickness of the tube portions.

Another preferred manufacturing method comprises the steps of forming a plurality of units having a plurality of tube portions, a plurality of rod portions each disposed between every set of adjacent tube portions and a plurality of plate portions connecting between the tube portions and the rod portions, and pressing the rod portions and the plate portions so that a section of each of the rod portions and the plate portions connected to both ends of each of the rod portions is formed into a thin plate portion and a thickness of the thin plate portion is less than a thickness of the tube portions.

A further preferred manufacturing method comprises the steps of preparing a plurality of thin plates, forming a plurality of first recessed portions extending in one direction in parallel to one another, forming a plurality of second recessed portions in each of the first recessed portions discontinuously, so that the second recessed portions are curved in a direction opposite to the curvature direction of each first recessed portion, and the second recessed portions and remaining portions of each first recessed portion form a hole as viewed from an end of each first recessed portion, and inserting a pipe into the hole and fixing the pipe in the hole.

In the heat exchanger according to the preferred embodiments, because each of the adjacent tube portions formed as fluid paths between first and second tanks are connected by a thin plate portion having a thickness less than that of the tube portions in each panel unit, the heat exchanger can be small and lightweight. Further, because the thin plate portions are formed by pressing or by initially using a thin plate, each plate portion can be easily formed to a desired length. Therefore, the heat exchanger may be more efficient.

BRIEF DESCRIPTION OF THE DRAWINGS

Some preferred exemplary embodiments of the invention will now be described with reference to the accompanying drawings, which are given by way of example only, and are not intended to limit the present invention.

FIG. 6D is a plan view in the method.

DETAILED DESCRIPTION OF PREFERRED EMBODIMENTS

Figure 1:
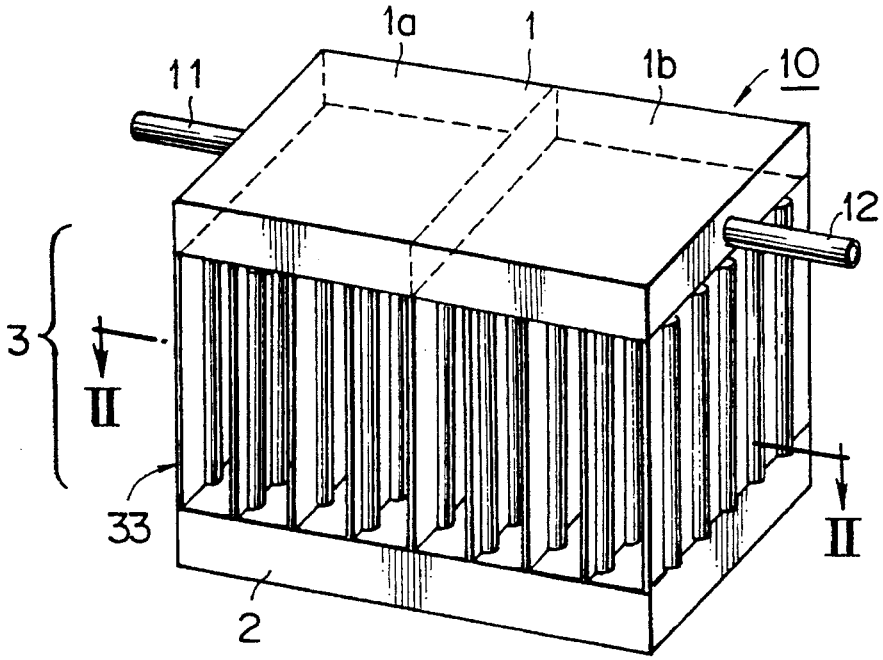
FIG. 1 is a perspective view of a heat exchanger according to a first embodiment of the present invention.
Figure 2:
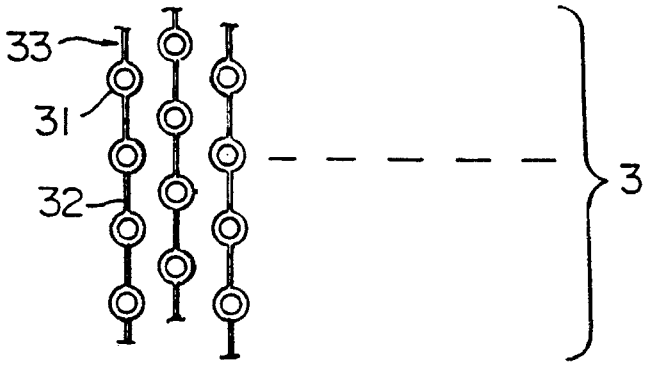
FIG. 2 is an enlarged partial cross-sectional view of the heat exchanger shown in FIG. 1, taken along line II—II of FIG. 1.
Figure 3:
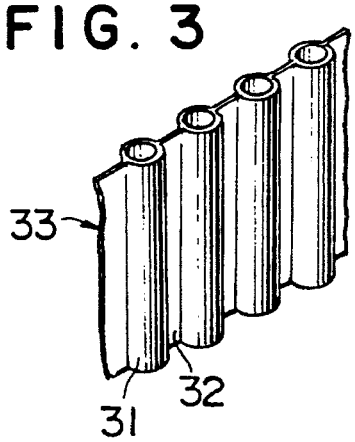
FIG. 3 is an enlarged partial perspective view of a panel unit of the heat exchanger shown in FIG. 1.

Referring to the drawings, FIGS. 1 to 3 depict a heat exchanger according to a first preferred embodiment. Heat exchanger 10 comprises an upper tank 1, a lower tank 2 and a heat exchanging portion 3 disposed between upper tank 1 and lower tank 2. Heat exchanging portion 3 comprises a plurality of panel units 33 spaced from one another and disposed in parallel to one another. The inside space of upper tank 1 is divided into two sections 1*a* and 1*b* by partition plate (shown by dotted lines). Inlet pipe 11 is connected to one section 1*a* of upper tank 1 at one end of the upper tank. Outlet pipe 12 is connected to the other section 1*b* of upper tank 1 at the other end of the upper tank. A fluid for heat exchange (for example, a refrigerant) sent to inlet pipe 11 flows from section 1*a* of upper tank 1 to lower tank 2 through heat exchanging portion 3. The fluid then flows from lower tank 2 to section 1*b* of upper tank 1 through heat exchanging portion 3 and is discharged through outlet pipe 12.

Panel units 33 are formed from a metal, such as an aluminum alloy or the like. Each panel unit 33 comprises a plurality of tube portions 31 and a plurality of plate portions 32 connecting adjacent tube portions 33 and forming both end portions of the panel unit. Tube portions 31 are formed as fluid paths communicating between upper and lower tanks 1 and 2. Tube portions 31 and plate portions 32 integrally form a single panel unit 33. The thickness of each plate portion 32 is less than the thickness of tube portions 31. In this embodiment, the thickness of tube portions 31 is set to about 0.4 mm, and the thickness of plate portions 32 is set to about 0.15 mm. It should be recognized that other thicknesses may be used as desired.

Panel units 33 are disposed so that tube portions 31 of one panel unit 33 face plate portions 32 of an adjacent panel unit 33, as shown in FIG. 2. Tube portions 31 of each panel unit 33 communicate between upper and lower tanks 1 and 2, and form fluid paths therebetween. Plate portions 32 of panel units 33 contribute to form an air path between each two adjacent panel units 33, and function to accelerate the heat exchange.

One preferred method for manufacturing a panel unit 33 will be explained with reference to FIGS. 4A–4D.

Figure 4A:
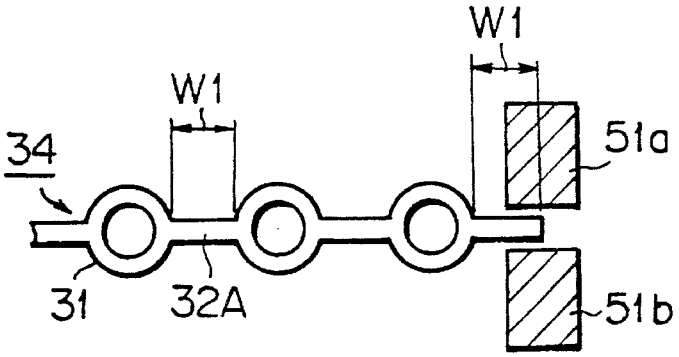
FIGS. 4A–4D are plan views showing a method for forming a panel unit of the heat exchanger shown in FIG. 1.
Figure 4B:
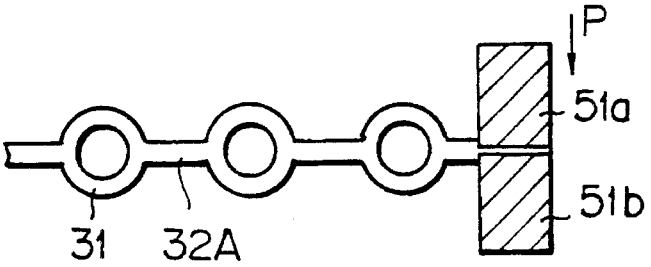
Figure 4C:
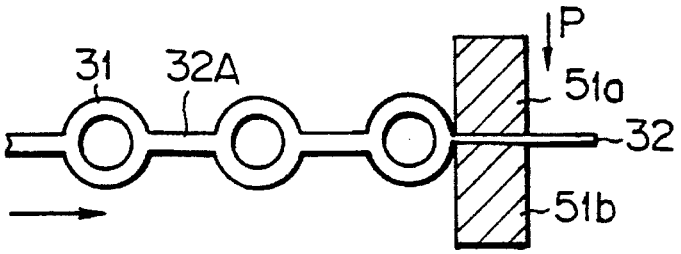
Figure 4D:
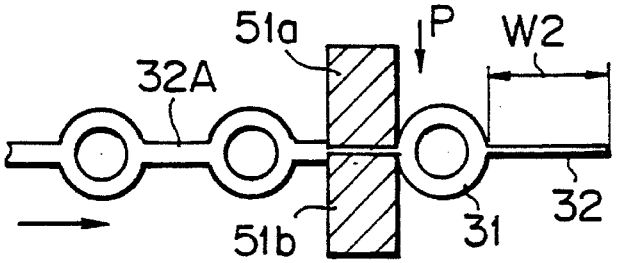

A unit 34 having a plurality of tube portions 31 and a plurality of plate portions 32A is formed by, for example, extrusion. After extrusion, plate portions 32A have a relatively large thickness of, for example, about 0.4 mm, and a relatively small width W1 of, for example, about 2.0 mm, as shown in FIG. 4A. The diameter of each tube portion 31 is set to, for example, about 3.0 mm. Plate portions 32A are then pressed at a pressure P successively by a pair of molds 51*a* and 51*b* to thin the plate portions 32A and to form plate portions 32 having a small thickness of, for example, about 0.15 mm, as shown in FIGS. 4B–4D. During pressing, the initial width W1 of each plate portion 32A is enlarged from about 2.0 mm to a width W2 of, for example, about 5.4 mm, which is about 2.7 times the initial width W1. Thus, a panel unit 33 having a plurality of tube portions with a diameter of 3.0 mm and a plurality of plate portions 32 with a thickness of about 0.15 mm and a width of about 5.4 mm can be manufactured.

Figure 5A:
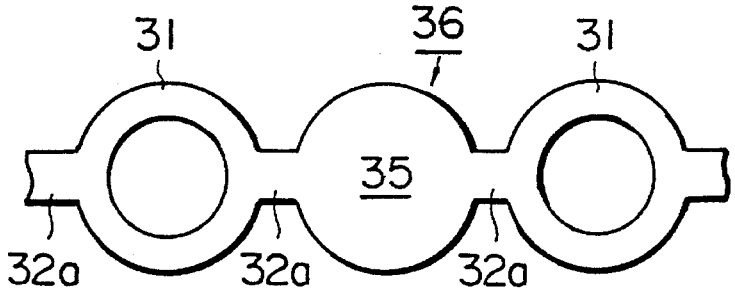
FIGS. 5A–5C are plan views showing another method for forming a panel unit of the heat exchanger shown in FIG. 1.
Figure 5B:
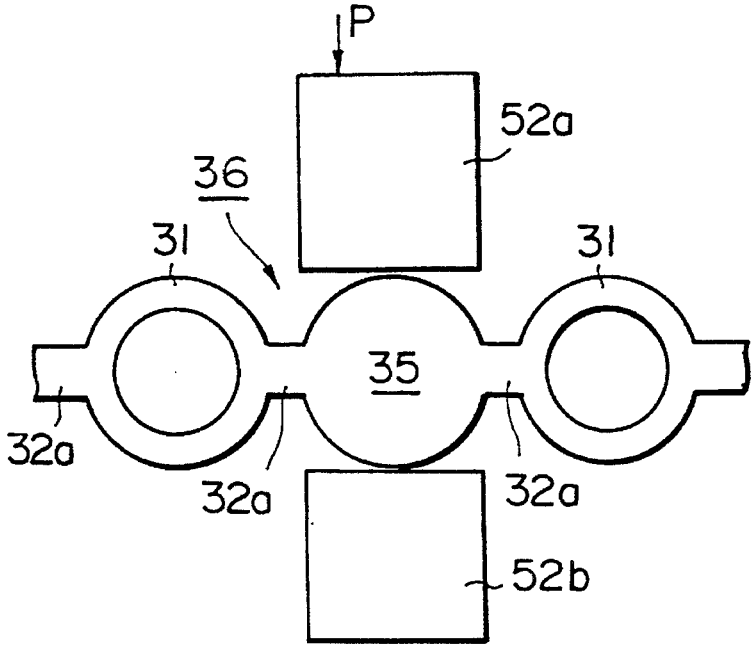
Figure 5C:
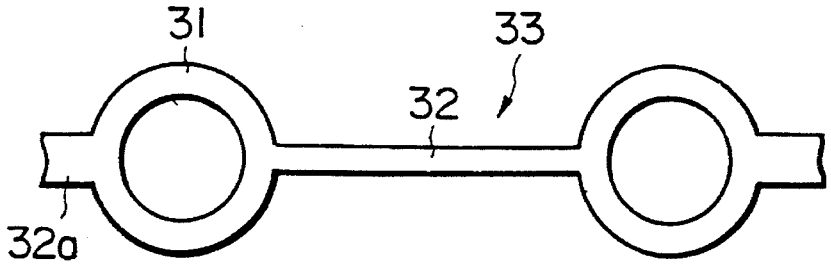

FIGS. 5A–5C depict another preferred method for manufacturing a panel unit 33.

In this preferred method, a unit 36 having a plurality of tube portions 31, a plurality of rod portions 35 and a plurality of plate portions 32*a* is formed by, for example, extrusion, as shown in FIG. 5A. Each rod portion 35 is disposed between every two adjacent tube portions 31. Plate portion 32*a* connects each rod portion 35 with adjacent tube portions 31, or is connected to an end tube portion 31. Rod portion 35 and plate portions 32*a* positioned on both sides of the rod portion 35 are pressed successively by a pair of molds 52*a* and 52*b* to form a plate portion 32 having a small thickness of, for example, about 0.15 mm, as shown in FIGS. 5B and 5C. According to this preferred method, a larger width of a plate portion 32 after pressing can be achieved as compared with the method shown in FIGS. 4A–4D because the rods comprise a larger amount of material to be pressed.

FIGS. 6A–6F depict a further preferred method for manufacturing a panel unit.

Figure 6A:
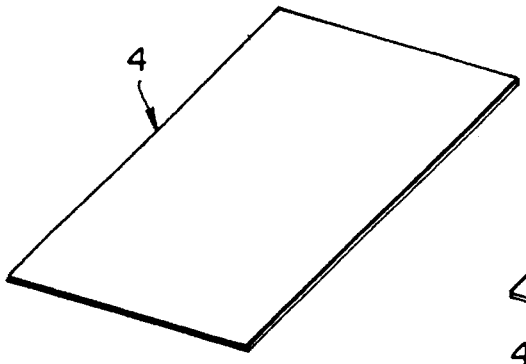
FIGS. 6A–6F show a further method for forming a panel unit of the heat exchanger shown in FIG. 1, FIGS. 6A–6C, 6E and 6F are perspective views in the method
Figure 6B:
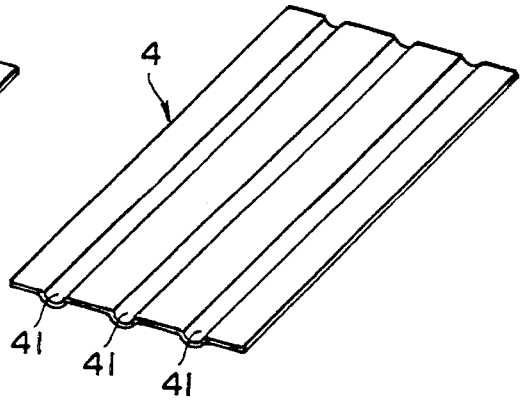
Figure 6C:
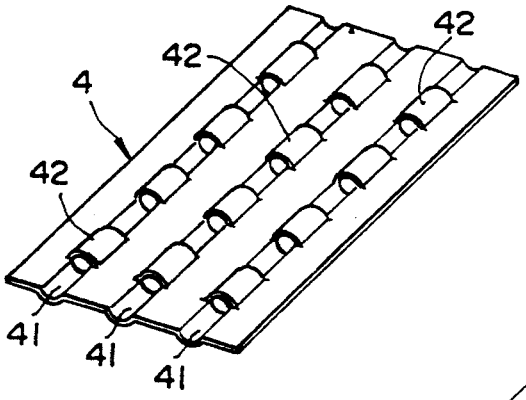
Figure 6D:
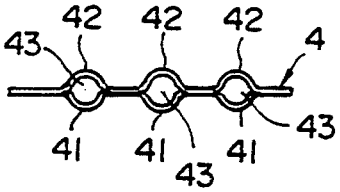
Figure 6E:
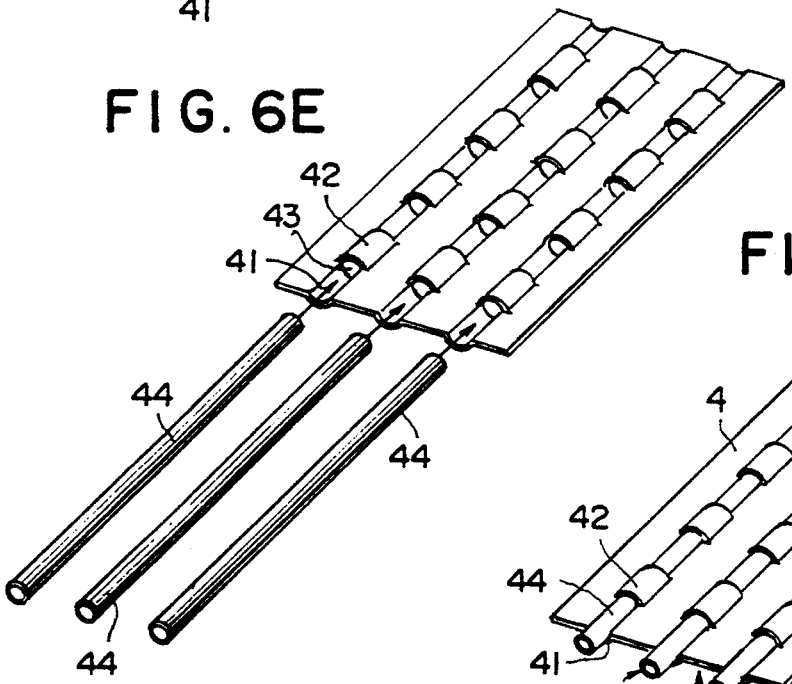
Figure 6F:
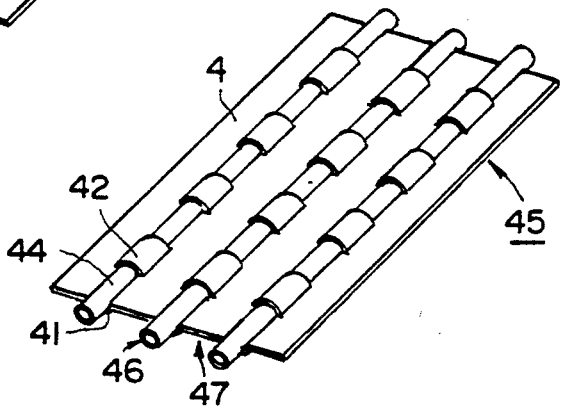

In this preferred method, a plurality of thin plates 4, one of which is shown in FIG. 6A, are prepared. Thin plate 4 is formed from a clad material such as, for example, a metal plate with a brazing material on both surfaces. First, a plurality of first recessed portions 41 extending in one direction in parallel to one another are formed by, for example, pressing, as shown in FIG. 6B. Thereafter, a plurality of second recessed portions 42 are formed from each of first recessed portions 41 discontinuously, so that the second recessed portions 42 are curved in a direction opposite to the curvature direction of each first recessed portion 41 as shown in FIG. 6C. Second recessed portions 42 and remaining portions of each of the first recessed portions 41 form a hole 43, as viewed from an end of each of the first recessed portions 41, as shown in FIG. 6D. A pipe 44 is inserted into each hole 43, as shown in FIG. 6E. First recessed portions 41 and second recessed portions 42 arranged in an axial direction constitute a pipe holding portion (a tube holding portion). Inserted pipes 44 are fixed in respective hole 43 by, for example, brazing. Thus, a panel unit 45 having tube portions 46 and plate portions 47, as shown in FIG. 6F, is completed.

Figure 7A:
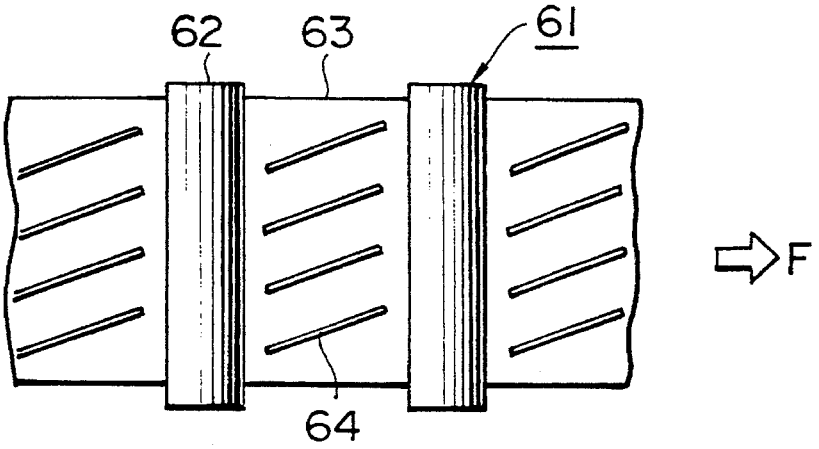
FIG. 7A is a partial elevational view of a panel unit of a heat exchanger according to a second embodiment of the present invention.
Figure 7B:
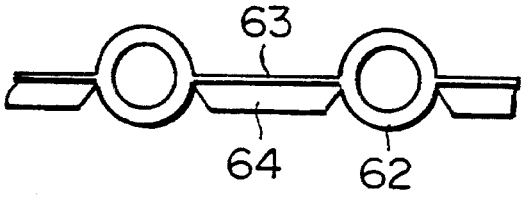
FIG. 7B is a plan view of the panel unit shown in FIG. 7A.
Figure 8:
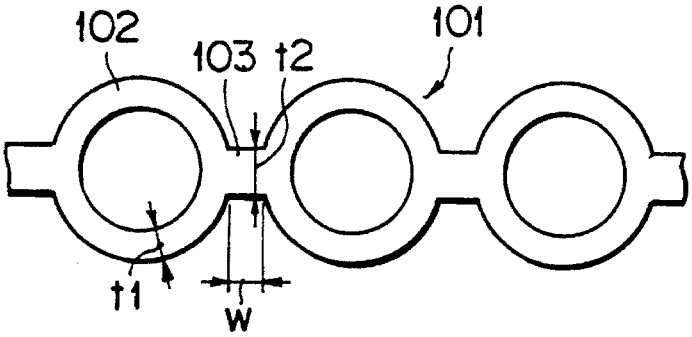
FIG. 8 PRIOR ART
FIG. 8 is a partial plan view of a conventional tube unit formed by extrusion.

FIGS. 7A and 7B depict a portion of a panel unit of a heat exchanger according to a further preferred embodiment. Panel unit 61 has a plurality of tube portions 62 and a plurality of plate portions 63 with a thickness less than that of the tube portions 62, similar to the structure of heat exchanger 10 shown in FIG, 1. In this embodiment, a plurality of louvers 64 are provided on each plate portion 63. Because thin plate portion 63 can be formed wider than a conventional plate portion, louvers 64 can be easily provided on the plate portion 63. Louvers 64 are preferably inclined relative to the direction of air flow F. The air passing through the heat exchanger at a position between panel units 61 comes into contact with louvers 64 enabling an efficient heat exchange.

Although several preferred embodiments of the present invention have been described in detail herein, it will be appreciated by those skilled in the art that various modifications can be made without materially departing from the novel and advantageous teachings of the invention. Accordingly, the embodiments disclosed herein are by way of example. It is to be understood that the scope of the invention is not to be limited thereby, but is to be determined by the claims which follow.

What is claimed is:

1. A method for manufacturing a heat exchanger including a first tank and a second tank, an inlet and an outlet each connected to either said first tank or said second tank, and a plurality of unitary panel units provided between and connected to said first and second tanks, each of said unitary panel units comprising a plurality of metallic tube portions formed as fluid paths communicating between said first and second tanks, the method comprising the steps of:

forming a plurality of unitary panel units having said plurality of metallic tube portions and a plurality of plate portions connecting adjacent metallic tube portions; and pressing said plate portions so that a thickness of said plate portions is less than a thickness of said metallic tube portions.

2. A method for manufacturing a heat exchanger including a first tank and a second tank, an inlet and an outlet each connected to either said first tank or said second tank, and a plurality of panel units provided between and connected to said first and second tanks, each of said panel units comprising a plurality of tube portions formed as fluid paths communicating between said first and second tanks, the method comprising the steps of:

forming a plurality of units having said plurality of tube portions, a plurality of rod portions each disposed between adjacent tube portions and a plurality of plate portions connected between said tube portions and said rod portions; and pressing said rod portions and said plate portions so that a section of each of said rod portions and said plate portions connected to both ends of said each of said rod portions is formed in a thin plate portion and a thickness of said thin plate portion is less than a thickness of said tube portions.

3. The method of claim 1 further comprising the step of providing at least one louver on at least one of said plate portions of at least one of said panel units.

4. The method of claim 2 further comprising the step of providing at least one louver on at least one of said plate portions of at least one of said panel units.

* * * * *